US005558287A

United States Patent [19]

Darsey et al.

[11] Patent Number: 5,558,287

[45] Date of Patent: Sep. 24, 1996

[54] APPARATUS AND METHOD TO PREVENT FLAILING DAMAGE TO A STRAND WOUND ON A SPOOL

[75] Inventors: Ralph J. Darsey, Lawrenceville; Gregory D. Horne, Stone Mountain, both of Ga.

[73] Assignee: Lucent Technologies Inc., Murray Hill, N.J.

[21] Appl. No.: 382,745

[22] Filed: Feb. 2, 1995

[51] Int. Cl.[6] ..... B65H 54/00; B65H 57/00

[52] U.S. Cl. ..... 242/18 R; 242/157 R

[58] Field of Search ..... 242/157 R, 18 EW, 242/18 G, 18 R, 35.6 E

[56] References Cited

U.S. PATENT DOCUMENTS

| | | | |
|---|---|---|---|
| 2,133,993 | 10/1938 | Knebusch et al. | 242/157 R |
| 3,263,407 | 8/1966 | Jones, Sr. | 242/18 R |
| 4,023,741 | 5/1977 | Schar | 242/18 R |
| 4,130,248 | 12/1978 | Hendrix et al. | 242/18 G |
| 5,029,762 | 7/1991 | Behrens et al. | 242/18 EW X |

*Primary Examiner*—Michael R. Mansen

[57] ABSTRACT

An apparatus and method for reducing or preventing damage to a strand wound at relatively high speed on a machine-rotated spool, caused by flailing of a loose end of the strand includes capture brushes arranged at intervals in proximity to the machine. The capture brushes are aligned to be approximately perpendicular to the loose end of the strand when the loose end of the strand rotates with the spool into contact with the brushes. At respective ends, the brushes have respective tips with a taper that tends to guide or deflect the loose end of the strand to a slot defined by two adjacent brushes. The brushes have bristles extending from a bristle-mounting member, which capture the loose end of the strand. The bristles can be treated with a friction enhancing substance to improve the ability of the brushes to capture and entrap the loose end of the strand. Preferably, the bristles are angled with respect to the bristle-mounting member in a direction away from a respective tapered tip. As so angled, the bristles allow the loose end of the strand to pass relatively easily between adjacent brushes in one direction, but capture and entrap the loose end of the strand and prevent it from recoiling in the opposite direction out of contact with the bristles. A loose end of the strand is thus captured before it can damage the strand wound on the spool. After capture, as the spool rotates, the loose end of the strand is drawn through the bristles of the adjacent brushes in a direction approximately perpendicular to the bristle-mounting members. Thus, flailing or whipping of the loose end of the strand against the strand wound on the spool is prevented.

14 Claims, 2 Drawing Sheets

APPARATUS AND METHOD TO PREVENT FLAILING DAMAGE TO A STRAND WOUND ON A SPOOL

BACKGROUND OF THE INVENTION

1. Field of the Invention

This invention is directed to an apparatus and method for preventing damage to a strand of material such as an optical fiber, plastic filament, wire, thread, yarn or string and the like, caused by flailing of a loose end of the strand against the strand wound on the spool as the spool rotates.

2. Description of the Related Art

In the optical fiber, plastic filament, wire, and textile manufacturing industries, for example, strands of filamentary material must be wound onto machine-rotated takeup spools. After a length of strand is wound onto a spool or if the strand breaks, the resulting loose end of the strand can flail the strand on the spool while the spool is rotating. Depending upon the fragility of the strand and the speed of rotation of the spool, damage to the strand already on the spool caused by flailing of its loose end can be significant. For example, the inventors have found flailing damage to optical fiber several layers deep on the spool. Thus, not uncommonly, flailing damage can result in the destruction of optical fiber lengths on the order of kilometers. Clearly, the elimination of this costly waste due to flailing damage would be desirable.

One conceivable solution to reduce flailing damage is to decrease the rotation speed of the spool. Of course, this solution necessarily reduces the rate at which a strand can be wound onto the spool, and would require additional spool rotating machines, and hence appreciable expense, to maintain a given strand winding rate. Consequently, there is a need for a solution that will reduce or prevent flailing damage while a strand of material is wound onto a spool at a relatively high speed.

SUMMARY OF THE INVENTION

This invention is an apparatus and method for reducing or preventing damage to a strand wound at relatively high speed on a machine-rotated spool, caused by flailing of a loose end of the strand. The apparatus includes a plurality of capture brushes arranged at intervals in a row, for example, in proximity to the machine. The brushes extend along the entire length of the spool, and preferably even beyond the ends of spool. Also, the brushes are sufficiently closely spaced so that their bristles contact and intermesh to a degree. The area of contact between bristles of adjacent brushes define respective capture slots for capturing the loose end of the strand. To be optimally positioned to capture the strand's loose end, the brushes are aligned with their lengths approximately perpendicular to a length of the end of the strand when the end of the strand rotates with the spool into contact with the brushes. With the brushes aligned in this manner, the capture slots between adjacent brushes are aligned with the direction of, or the plane of, movement of the strand's end so that the brushes can capture and entrap the strand's end in a slot between adjacent brushes. The brushes have respective tapered tips attached at ends thereof which deflect and guide the strand's end away from the central end of the brushes and toward a slot between two adjacent brushes. The bristles of the brushes extend from respective bristle-mounting members, and preferably, rather than extending perpendicularly outward from each bristle-mounting member, they are angled relative to the bristle-mounting member in a direction away from the respective tapered tip attached at the end of the bristle-mounting member. As angled in this manner, the bristles at the end of each brush guide the end toward the capture slot between brushes. Also, with this angling, the bristles allow the loose end of the strand to pass relatively easily in the slot between adjacent brushes in one direction, but capture and entrap the end of the strand and prevent it from recoiling in the opposite direction out of contact with the bristles. The end of the strand is thus captured before it can damage the strand wound on the spool. The bristles can be treated with a friction enhancing substance to improve the ability of the bristles to capture and entrap the end of the strand. In any case, once entrapped in a slot, the end of the strand is pulled by the rotating spool more or less perpendicularly to the plane of the brushes so that the strand's end does not cause flailing damage.

The ends of the brushes that are opposite the tapered tips can be attached to and arranged at intervals along a mounting member. The brushes and the mounting member together define a brush assembly. The mounting member is rotatably mounted in swivel mounts attached to and supported by the machine or other support. By rotation of the brush assembly in the swivel mounts, the alignment of the brushes can be adjusted and fixed to capture the strand's loose end in a first position in which the lengths of the brushes are approximately perpendicular to the length of the end of the strand when the strand's end rotates with the spool into contact with the brushes. Also, the brush assembly can be rotated in the swivel mounts to a second position in which the brushes will not interfere with the mounting or dismounting of a spool from the spool-rotating machine. A rotary actuator, for example, can be coupled to an end of the mounting member and used to move the brush assembly between the first and second positions.

A method of this invention includes steps of rotating a spool to wind a strand onto the spool and capturing a loose end of the strand to prevent the end of the strand from flailing the strand wound on the spool. This method can also include a step of deflecting or guiding the end of the strand to a slot defined between two adjacent brushes for capture. The guiding can be performed by one of the tapered tips attached to the two adjacent brushes, and by the angled bristles.

These together with other objects and advantages, which will become subsequently apparent, reside in the details of construction and operation as more fully hereinafter described and claimed, reference being had to the accompanying drawings, forming a part hereof, wherein like numerals refer to like parts throughout.

BRIEF DESCRIPTION OF THE DRAWINGS

The present invention can be better understood with reference to the following drawings. The drawings are not necessarily to scale, emphasis instead being placed upon clearly illustrating the principles of the present invention.

DESCRIPTION OF THE PREFERRED EMBODIMENTS

Figure 1:
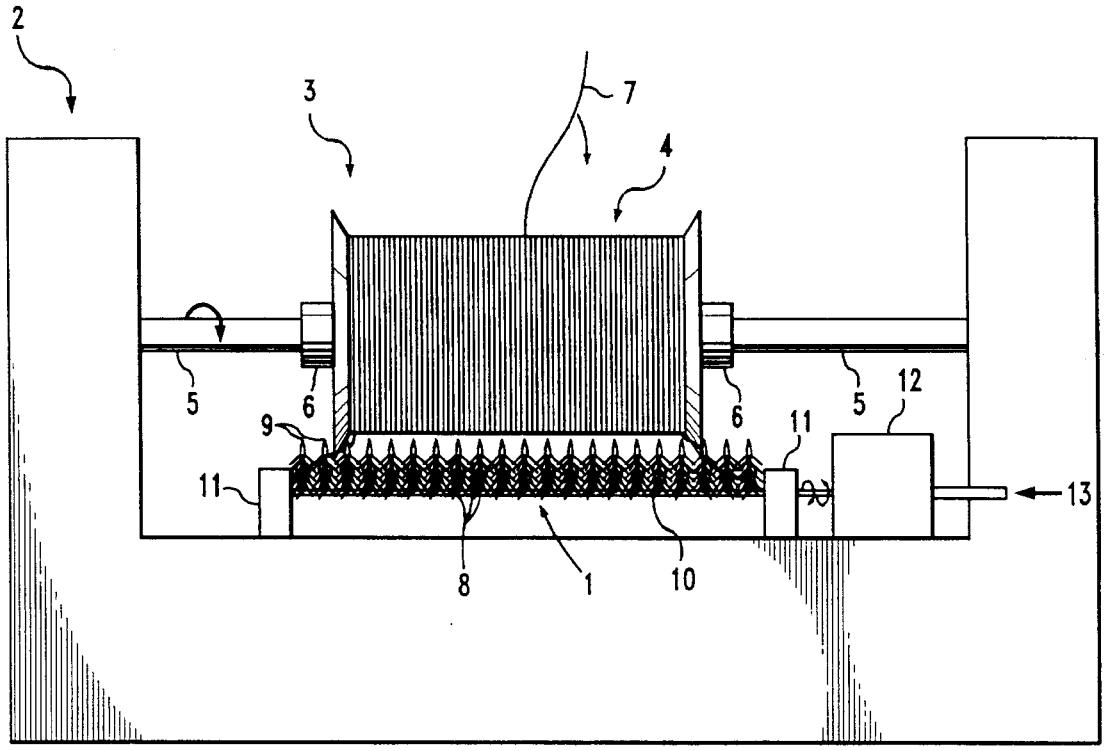
FIG. 1 is a view of a brush assembly in accordance with this invention, arranged in proximity to a spool-rotating machine.

In FIG. 1, a brush assembly 1 is arranged in proximity to a machine 2 for rotating a spool 3 at a relatively high speed. The machine 2 rotates the spool 3 with a motor (not shown in FIG. 1) coupled to at least one of two shafts 5. To the ends of the shafts 5, respective spool mounts 6 are attached. The shafts 5 can be moved together to engage the spool mounts 6 with respective ends of the spool 3, to mount the spool 3 in the machine 2. Also, the shafts 5 can be moved apart to disengage the spool mounts 6 from the spool 3, to dismount the spool 3 from the machine 2. When the spool mounts 6 are engaged with respective ends of the spool 3 and the motor is activated, the motor imparts a torque to the spool 3 via the shafts 5 and the spool mounts 6. Thus, the spool rotates in the direction shown in FIG. 1.

Before rotation of the spool 3, an end of a strand 4 is attached to the spool 3. The strand 4 can be a material such as optical fiber, plastic filament, insulated or uninsulated wire, thread, yarn or string and the like.

As the spool 3 rotates, the strand 4 is wound onto the spool 3 from a supply (not shown in FIG. 1). The supply of the strand 4 can be provided from another spool or a machine that manufactures the strand 4, for example. When the supply is exhausted or if the strand 4 breaks, a loose end 7 results. The inventors have found that this loose end can flail the strand 4 wound on the spool 3, particularly if the loose end 7 rebounds off a structure near the spool, such as, for example, a surface of the machine 2. In accordance with this invention, the brush assembly 1 is adapted to capture and entrap the end 7 before it can damage the strand 4 on the spool 3.

The brush assembly 1 includes a plurality of brushes 8, a plurality of tapered tips 9 and a mounting member 10. Preferably, the brushes 8 are arranged at intervals in the brush assembly 1 along the length of the spool 3 and extend beyond the ends of the spool 3 to a distance sufficient to capture the loose end 7 of the strand should it move outwardly of the ends of the spool. To capture the loose end 7 of a strand 4, the lengths of the brushes 8 (only a two of which are specifically indicated in FIG. 1) are aligned in FIG. 1 approximately perpendicular to the length of the end of the strand when the loose end of the strand, rotating with the spool 3, moves into contact with the brushes 8. To the ends of the brushes 8, respective tapered tips 9 (only a few of which are specifically indicated in FIG. 1 ) are attached. The other ends of the brushes 8 are mounted in the mounting member 10. The mounting member 10 can be a metal, wood or plastic bar, for example, with holes receiving the ends of the brushes 8. The holes can be sized so that the ends of the brushes 8 fit snugly into the holes and are rigidly held in place. The brushes 8 can be fixed in the holes with set screws (not shown) perpendicularly engaging with the ends of the brushes 8, or can be fixed in the holes with an adhesive.

The mounting member 10 is rotatably mounted to and supported by swivel mounts 11. The swivel mounts 11 are made of metal or plastic, for example, with bearings that receive the mounting member 10. The swivel mounts are attached to and supported by a surface of the machine 2 or other support. An end of the mounting member 10 is coupled to a rotary actuator 12. The rotary actuator 12 serves to rotate the mounting member 10, and hence the brush assembly 1, about its longitudinal axis. The rotary actuator 12 moves the brushes 8 between a first position as shown in FIG. 1, in which the brushes 8 are aligned to capture the loose end of the strand 4, and a second position (for example, in which the brushes 8 are aligned out of the plane of the sheet of FIG. 1) so that the spool 3 can be mounted or dismounted from the spool mounts 6 without interference from the brush assembly 1. For example, the rotary actuator 12 can be a pneumatic device in which case a compressed air supply 13 is selectively provided to the rotary actuator 12 to rotate the brush assembly 1 between the first and second positions. Of course, the rotary actuator 12 can be realized with other devices such as an electrical actuator or manual actuation by a person.

Figure 2:
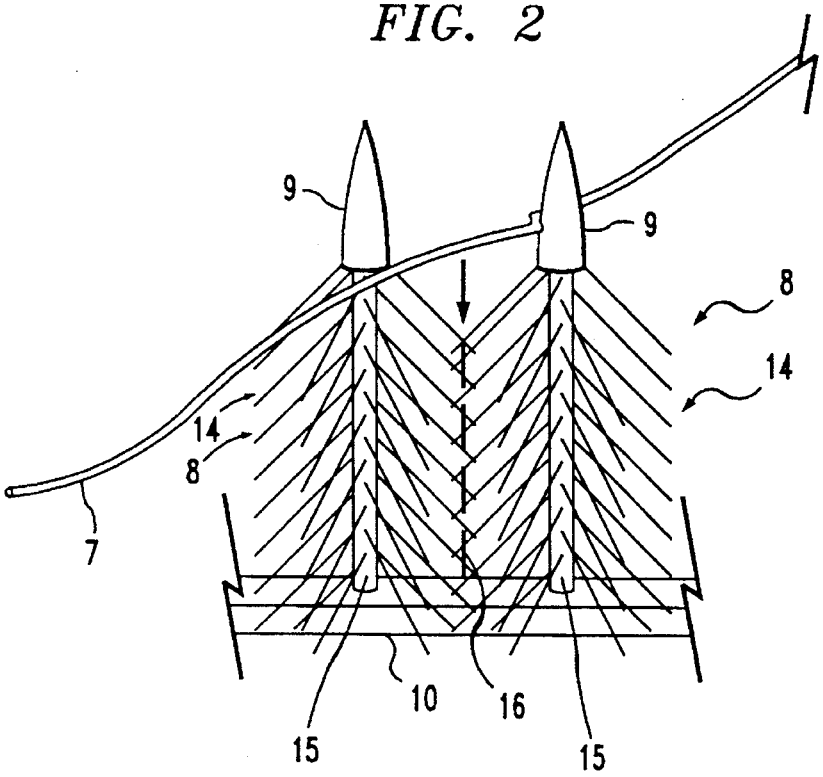
FIG. 2 is a view of two adjacent brushes of the brush assembly in the act of guiding the loose end of a strand toward a slot between the brushes.

FIG. 2 shows two adjacent brushes 8 of the brush assembly 1 in the act of deflecting or guiding a loose end 7 of a strand 4 toward a slot 16 (shown in broken line in FIGS. 2 and 3) defined by adjacent brushes 8. In FIG. 2, the end 7 has rotated with the spool 3 (not shown in FIG. 2) to make contact with a tapered tip 9 on the right-hand side of FIG. 2. Because at this time the end 7 of the strand 4 is rotating with the spool 3, the end 7 tends to move in the direction shown by the arrow in FIG. 2. Therefore, the end 7 slides on the tapered surface of the tip 9 downward and is deflected by the tip 9 to the left in FIG. 2 toward the slot 16 defined by the two adjacent brushes 8 for capture.

The tapered tips 9 provide two important functions. First, the tapered tips 9 facilitate capture of the end 7 by deflecting or guiding the end 7 toward a slot 16 on one side or the other of the tapered tip 9, depending upon which side of the point the end 7 strikes. Second, the tapered tips 9 deflect the end 7 away from the central end of respective brushes 8. In the absence of the tapered tips 9, if the end 7 strikes the brush 8 squarely on its end, the end 7 can rebound and cause flailing damage. Thus, the tapered tips 9 eliminate the relatively broad surface that would otherwise be presented to the end 7 by the central end of respective brushes 8.

The tapered tips 9 are preferably formed of plastic, wood or metal, for example, made with a pointed conical or bullet-like shape. The tapered tips 9 should be pointed as much as possible so that the loose end 7 will not tend to rebound after hitting a tapered tip.

Although FIG. 2 shows a situation in which the end 7 happens to strike a tapered tip 9, the end 7 can of course hit the bristles 14 of a brush(es) 8 without encountering a tapered tip. Preferably, at least the upper bristles 14 are angled in a manner described below, so that the bristles 14 tend to guide the end 7 toward the slot 16.

Figure 3:
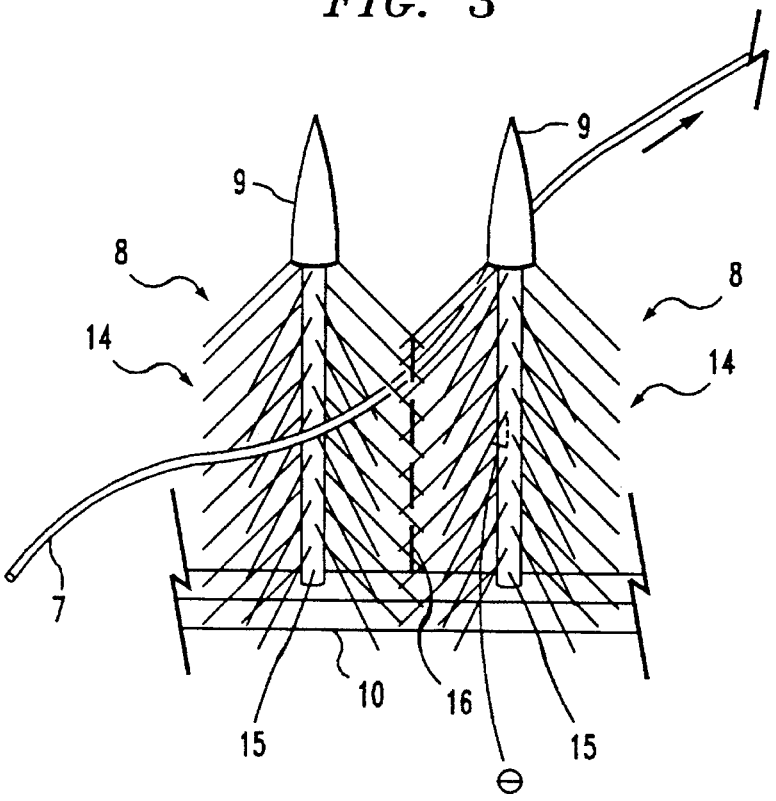
FIG. 3 is a view of two adjacent brushes of the brush assembly after capturing and entrapping the loose end of the strand in the bristles of adjacent brushes.

FIG. 3 is a diagram of a portion of the brush assembly 1 in the act of capturing and entrapping the loose end 7 of the strand 4. The angular speed of rotation of the loose end 7 with the spool 3 is sufficient to drive the end 7 to a depth in the slot 16 between intermeshing bristles 14 of respective adjacent brushes 8. The bristles 14 can be formed from relatively thin lengths of materials such as monofilament, metal, hair, straw or other fiber-like material. The bristles 14 are attached to respective bristle mounting members 15 that have ends attached to the mounting member 10. The bristle mounting members 15 serve to support respective bristles 14. For example, the bristle mounting members 15 can be formed by a length of twisted wires or a length of metal, wood or plastic. If the bristle mounting members 15 are realized as lengths of twisted wires, the bristles 14 can be attached by placing the bristles between the wires before twisting them together, and then twisting the wires with sufficient tightness that the bristles are held firmly in position in a configuration commonly used to make test tube brushes. Alternatively, if a length of metal, wood, plastic or the like is used to realize the bristle mounting members 15, the bristles can be adhered or otherwise attached to the bristle mounting members 15. The bristles 14 can be attached to the bristle mounting member 15 so as to radiate outward from all sides of the bristle mounting member, or the bristles 14 can be attached to the bristle mounting member 15 in a limited area, for example, on the sides of the bristle mounting member which face other brushes 8.

Preferably, the bristles 14 are attached so as to be angled with respect to the bristle mounting members 15 in a direction away from the tapered tips 9. For example, the bristles 14 can be angled at angles θ (only one of which specifically is shown in FIG. 3) from 1°–89° relative to the bristle mounting member 15. As angled in this manner, the bristles 14 guide the end 7 toward the slot 16. Also, as so angled, the bristles 14 allow the end 7 to pass relatively easily into the slot 16 between the brushes 8 in a downward direction in FIG. 3. However, the angling of the bristles 14 tends to block and prevent the end 7 from recoiling upward in FIG. 3 out of contact with the brushes 8 in a direction opposite to that in which the end 7 moves into the slot between the adjacent brushes 8, particularly if the bristles 14 intermesh. Thus, the end 7 is captured and entrapped. After entrapment, the end 7 cannot rotate with the spool 3 to rebound off a surface of the machine 2, for example, to whip or flail and thereby damage the strand 4 wound on the spool. Once entrapped, as shown in FIG. 3, the loose end 7 is drawn in a direction more or less into the plane of the sheet of FIG. 3 to be wound smoothly onto the spool 3 without whipping or flailing the strand wound onto the spool.

The brushes 8 can be formed, for example, using a test tube brush with a twisted bristle mounting member 15 holding plastic bristles 14. To form the angling of the bristles 14 with respect to the bristle mounting member 15, the test tube brush can be inserted into a test tube and heated to the softening point of the plastic bristles. When cooled, the plastic bristles 14 will be angled with respect to the bristle mounting member 15 to a degree determined by the diameter of the test tube and the length of the bristles 14. Alternatively, the brush 8 can include metal bristles 14 in which case the bristles 14 can be physically bent to a predetermined angle with respect to the bristle mounting member 15 due to the malleability of the metal bristles 14. The ends of the test tube brush can be cut and a tapered tip 9 can be attached to an end of the brush 8. The other end of the brush 8 can be mounted in the mounting member 10. After a plurality of brushes 8 are mounted as described above to the mounting member 10, manufacture of the brush assembly 1 is completed. For example, the brushes 8 can be mounted to the mounting member 10 in a single linear row as shown in FIG. 1, or can include several rows or other arrangements.

To enhance the ability of the brushes 8 to capture the loose end 7 of the strand 4, a friction enhancing substance such as E6000™ adhesive/sealant made by Eclectic™ Corp. of Carson, Calif., can be applied to the bristles 14. Preferably, the friction enhancing substance is applied to the lower bristles 14 (that is, the bristles 14 relatively near the mounting member 10) so that the loose end 7 will slide relatively easily through the upper bristles 14 to contact with the bristles 14 treated with the friction enhancing substance which tends to hold the end 7 in the lower bristles 14. Although the friction enhancing substance can be used to improve the ability of the bristles 14 to capture and entrap the end 7, this substance is not essential to the performance of the brush assembly 1, and if desired, its use can be dispensed with.

In operation, the shafts 5 of the machine 2 of FIG. 1 are moved apart and the rotary actuator 12 is activated to rotate the brush assembly 1 into a position in which the brush assembly will not interfere with the loading of the spool 3 into the machine 2. A spool 3 is placed in position in the machine 2 and the shafts 5 are brought together so that the spool mounts 6 engage with respective ends of the spool 3. A strand 4 is attached to the spool 3 and the rotary actuator 12 is activated to rotate and fix the brush assembly 1 into a position suitable for capture and entrapment of the loose end 7. The machine 2 is activated so that its motor drives the shaft(s) 5 to rotate the spool 3 so that the strand 4 is wound onto the spool from a supply of the strand 4. When the supply is exhausted or if the strand 4 breaks while winding the strand onto the spool 3, the end 7 is temporarily free to rotate with the spool until the end 7 makes contact with the brush assembly 1. If the end 7 encounters a tapered tip 9, the end 7 is guided in a direction toward the slot 16 between two adjacent brushes 8. Alternatively, the loose end 7 can strike the brush assembly 1 in between two adjacent brushes 8 so that no contact is made with a tapered tip 9, in which case the bristles 14 guide the end 7 toward a slot 16 defined between the adjacent brushes 8. The momentum of the loose end 7 drives it into the slot. Due to the angling of the bristles 14, the end 7 passes relatively easily into the slot between the bristles, but is prevented from rebounding out of contact with the bristles, particularly if the bristles of the adjacent brushes intermesh. As the spool 3 continues to rotate, the loose end 7 is drawn out of the bristles 14 in a direction approximately perpendicular to the bristle-mounting members 15. After the machine 2 is stopped, the shafts 5 can be moved apart so that the spool mounts 6 disengage with respective ends of the spool 3. The spool 3 loaded with the strand 4 can then be lifted out of the machine 2.

In experiments, the inventors have determined that this invention significantly reduces the occurrence of flailing damage. Specifically, in the case of optical fiber strand material, the invention has provided an 87% reduction in the occurrence of flailing damage. Thus, this invention provides a relatively inexpensive, yet effective solution to reduce or prevent flailing damage that can achieve substantial cost savings by eliminating waste in industries that require the winding of strand material onto a spool.

Although the invention has been described with specific illustrations and embodiments, it will be clear to those of ordinary skill in the art that various modifications may be made therein without departing from the spirit and the scope of the invention.

We claim:

1. For use with a machine for rotating a spool to wind a filamentary strand onto the spool, wherein the strand has a loose end occurring during or at the end of the winding that rotating with the rotating spool and tends to flail against the strand wound on the spool an apparatus comprising:

means for capturing the loose end of the strand during rotation of the spool, said means comprising at least a first and a second brush member adjacent each other and spaced from the spool when the spool is mounted in the machine, each brush member comprising an elongated bristle mounting member and a plurality of bristles mounted therein and extending outwardly from said bristle mounting member;

adjacent brush members being sufficiently close to each other that at least some of said outwardly extending bristles of said first brush member overlap and mesh with said outwardly extending bristles of said second brush member to define a slot for capturing the loose end of the strand, said intermeshing bristles being oriented transversely relative to the direction of movement of the loose end of the strand during rotation of the spool.

2. An apparatus as claimed in claim 1 and further comprising:

guide means for guiding the loose end of the strand into contact with said bristles of said brush members for capture thereby, said guide means comprising a tapered tip on each of said bristle mounting members.

3. An apparatus as claimed in claim 2, wherein said bristles on each of said bristle mounting members are angled away from said tapered tip.

4. An apparatus as claimed in claim 3 wherein said bristles on each of said brush members are oriented at angles relative to said bristles mounting member in a range from 1° to 89° relative to said bristles guide the loose end of the strand into said slot between said bristles of adjacent brush members along a first direction, and prevent the loose end of the strand from escaping from said bristles along a second direction opposite to the first direction.

5. An apparatus as claimed in claim 1 and further comprising:

a friction enhancing substance on said bristles of at least one of said brush members to enhance capture of the loose end of the strand.

6. An apparatus as claimed in claim 1 and further comprising:

a brush mounting member along which said brush members are mounted in an array, said brush mounting member being positioned at a location spaced from the spool when the spool is mounted in the machine.

7. An apparatus as claimed in claim 6 and further comprising:

a swivel mount supporting said brush mounting member, said brush mounting member being rotatably mounted to said swivel mount whereby the position of the brush members can be adjusted relative to the spool by rotation of said brush mounting member in said swivel mount.

8. An apparatus as claimed in claim 7, wherein said brush mounting member can be rotated in said swivel mount into a first position relative to the spool when the spool is in the machine in which the loose end of the strand can be captured when the spool is rotated and into a second position that allows the spool to be inserted into or extracted from the machine without interference by said brush members.

9. An apparatus as claimed in claim 6 wherein said array of brushes extends substantially parallel to the spool when the spool is mounted in the machine and beyond the ends of the spool.

10. A method of winding a filamentary strand on a spool comprising the steps of:

(a) mounting the spool onto a winding means;

(b) arranging a plurality of brushes having bristles thereon in a longitudinal array wherein bristles of adjacent brushes intermesh to define strand capture slots between the adjacent brushes;

(c) positioning the array of brushes in spaced proximity to the spool and substantially parallel thereto;

(d) attaching a first end of the strand to the spool;

(e) rotating the spool to wind the strand thereon until a second, loose end of the strand rotates with the spool; and (f) capturing the loose end of the strand in one of the slots defined between adjacent brushes to prevent the loose end of the strand from flailing that portion of the strand wound on the spool while the spool continues to rotate.

11. The method as claimed in claim 10 and further including the step of:

(g) deflecting the loose end of the strand into one of the capture slots while the spool is rotating.

12. An apparatus for capturing a loose end of a strand wound on a spool that is rotated by a machine, the apparatus comprising:

a brush positioned at a location spaced from the spool when the spool is mounted in the machine, the brush including at least a first and second elongated, substantially parallel, members, each having an end, a plurality of bristles mounted to and extending outwardly from the elongated member for capturing the loose end of the strand, and a tapered tip attached to the end of the elongated member, the tapered tip for deflecting the strand away from the end of the elongated member and toward the bristles for capture.

13. An apparatus as claimed in claim 12, wherein the bristles are angled away from the tapered tip.

14. An apparatus as claimed in claim 13, wherein respective angles defined between the elongated member and the bristles are in a range from 1° to 89°.

* * * * *